US010457881B2

(12) United States Patent
Droubi et al.

(10) Patent No.: US 10,457,881 B2
(45) Date of Patent: Oct. 29, 2019

(54) FUEL COMPOSITIONS

(71) Applicant: SHELL OIL COMPANY, Houston, TX (US)

(72) Inventors: Danny F. Droubi, Houston, TX (US); Michael Allen Branch, Spring, TX (US); Cynthia Delaney-Kinsella, Houston, TX (US); Dana Tatum Lipinsky, Houston, TX (US); Lawrence Stephen Kraus, Dickinson, TX (US); Tommy Louis Brumfield, Spring, TX (US); Ariel Bru, Ryswijk (NL); Koen Steernberg, Amsterdam (NL); Pierre Tardif, Houston, TX (US); Shannon Boudreaux, Houston, TX (US)

(73) Assignee: SHELL OIL COMPANY, Houstotn, TX (US)

( * ) Notice: Subject to any disclaimer, the term of this patent is extended or adjusted under 35 U.S.C. 154(b) by 22 days.

(21) Appl. No.: 15/350,170

(22) Filed: Nov. 14, 2016

(65) Prior Publication Data

US 2017/0058223 A1 Mar. 2, 2017

Related U.S. Application Data

(60) Continuation of application No. 14/611,418, filed on Feb. 2, 2015, now Pat. No. 9,499,758, which is a division of application No. 14/313,216, filed on Jun. 24, 2014, now Pat. No. 8,987,537.

(60) Provisional application No. 62/002,005, filed on May 22, 2014.

(51) Int. Cl.

| | |
|---|---|
| ***C10L 1/04*** | (2006.01) |
| ***C10L 1/08*** | (2006.01) |
| ***C10L 10/02*** | (2006.01) |

(52) U.S. Cl.

CPC ..... *C10L 1/04* (2013.01); *C10L 1/08* (2013.01); *C10L 10/02* (2013.01); *C10G 2300/202* (2013.01); *C10G 2300/203* (2013.01); *C10G 2300/302* (2013.01); *C10G 2300/304* (2013.01); *C10G 2300/308* (2013.01); *C10L 2200/043* (2013.01); *C10L 2200/0438* (2013.01); *C10L 2200/0453* (2013.01); *C10L 2200/0469* (2013.01); *C10L 2270/02* (2013.01); *C10L 2270/026* (2013.01)

(58) Field of Classification Search

CPC ..... C10L 1/04; C10L 2270/02; C10L 2200/0438; C10L 1/08; C10L 10/02; C10L 2270/026; C10L 2200/0453; C10L 2200/0469; C10L 2200/043; C10G 2300/308; C10G 2300/304; C10G 2300/302; C10G 2300/203; C10G 2300/202

See application file for complete search history.

(56) References Cited

U.S. PATENT DOCUMENTS

| | | | | |
|---|---|---|---|---|
| 3,868,231 | A | 2/1975 | Van De Kraats et al. | |
| 4,006,076 | A | 2/1977 | Christensen et al. | |
| 4,208,190 | A | 6/1980 | Malec | |
| 4,415,438 | A | 11/1983 | Dean et al. | |
| 6,265,629 | B1 | 7/2001 | Fava et al. | |
| 7,651,605 | B2 | 1/2010 | Sahara et al. | |
| 7,906,010 | B2 | 3/2011 | Keusenkothen et al. | |
| 8,193,401 | B2 | 6/2012 | McGehee et al. | |
| 8,897,537 | B2 | 11/2014 | Cosatto et al. | |
| 8,987,537 | B1 * | 3/2015 | Droubi | C10L 1/04 208/15 |
| 9,057,035 | B1 * | 6/2015 | Kraus | C10L 1/04 |
| 9,487,718 | B2 * | 11/2016 | Kraus | C10L 1/04 |
| 9,499,785 | B2 * | 11/2016 | Vassiliev | C12N 5/0604 |
| 2004/0144689 | A1 * | 7/2004 | Berlowitz | C10L 1/08 208/15 |
| 2007/0240361 | A1 | 10/2007 | Clayton et al. | |
| 2011/0277377 | A1 | 11/2011 | Novak et al. | |
| 2012/0246999 | A1 * | 10/2012 | Stern | C10G 45/02 44/300 |
| 2013/0014431 | A1 | 1/2013 | Jin et al. | |
| 2013/0098322 | A1 | 4/2013 | Tonti et al. | |
| 2013/0340323 | A1 | 12/2013 | Stern et al. | |

(Continued)

FOREIGN PATENT DOCUMENTS

| | | | |
|---|---|---|---|
| CN | 101921633 | A | 10/2010 |
| CN | 102766489 | A | 11/2012 |

(Continued)

OTHER PUBLICATIONS

International Search Report dated Nov. 17, 2014 of PCT/US2014/045723 filed Jul. 8, 2014.

International Search Report and Written Opinion received for PCT Patent Application No. PCT/US2014/043808, dated Feb. 11, 2015, 11 pages.

*Primary Examiner* — Pamela H Weiss

(57) ABSTRACT

Low sulphur marine fuel compositions are provided. Embodiments comprise greater than 50 to 90 wt % of a residual hydrocarbon component comprising at least one of an atmospheric tower bottoms (ATB) residue and a vacuum tower bottoms residues (VTB), wherein the residual hydrocarbon component has a kinematic viscosity at ~50 degrees C. of at least 100 cSt; and at least 10 and up to 50 wt % of a non-hydroprocessed hydrocarbon component comprising deasphalted oil (DAO), where the marine fuel composition has a kinematic viscosity at ~50 degrees C. of at least 10 cSt. Embodiments of the marine fuel composition can have a sulphur content of about 0.1 wt % or less.

14 Claims, No Drawings

(56) References Cited

U.S. PATENT DOCUMENTS

| | | | |
|---|---|---|---|
| 2014/0027344 | A1 | 1/2014 | Harris et al. |
| 2014/0174980 | A1 | 6/2014 | Brown et al. |
| 2015/0353851 | A1 | 12/2015 | Buchanan |

FOREIGN PATENT DOCUMENTS

| | | | | | |
|---|---|---|---|---|---|
| EP | 147240 | | | 7/1985 | |
| EP | 482253 | | | 4/1992 | |
| EP | 557516 | | | 7/1993 | |
| EP | 613938 | | | 9/1994 | |
| GB | 960493 | | | 6/1964 | |
| GB | 1525508 | A | * | 9/1978 | ..... B01J 23/888 |
| WO | 97027270 | | | 7/1997 | |
| WO | 9842808 | | | 10/1998 | |
| WO | 2012135247 | | | 10/2012 | |
| WO | WO 2012135247 | A1 | * | 10/2012 | ..... C10G 45/02 |
| WO | 2013001376 | | | 1/2013 | |
| WO | 2013033580 | | | 1/2013 | |
| WO | 2013134793 | | | 9/2013 | |

* cited by examiner

FUEL COMPOSITIONS

The application is a continuation of U.S. patent application Ser. No. 14/611,418, filed Feb. 2, 2015, which is a divisional of U.S. patent application Ser. No. 14/313,216, filed Jun. 24, 2014, now a U.S. Pat. No. 8,987,537, issued Mar. 24, 2015, which claims the benefit of U.S. Provisional Patent Application Ser. No. 62/002,005, filed on May 22, 2014, the entire disclosure of which is hereby incorporated by reference.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of any prior art.

The present disclosure generally relates to marine fuel compositions, specifically marine fuel compositions comprising at least one residual hydrocarbon component.

Marine vessels used in global shipping typically run on marine fuels, which can also be referred to as bunker fuels. Marine fuels include distillate-based and residues-based ("resid-based") marine fuels. Resid-based marine fuels are usually preferred because they tend to cost less than other fuels, but they often, and typically, have higher sulfur levels due to the cracked and/or residual hydrocarbon components that typically make up the resid-based marine fuels. The International Maritime Organization (IMO), however, imposes increasingly more stringent requirements on sulfur content of marine fuels used globally. In addition, IMO imposes more strict marine fuel sulfur levels in specific regions known as Emission Control Areas, or ECAs. The regulations will require a low-sulfur marine fuel with a maximum sulfur content of 0.1 wt % (1000 wppm) for the ECA in the near future. One conventional way of meeting the lower sulfur requirements for marine vessels is through the use of distillate-based fuels (e.g., diesel) with sulfur levels typically significantly below the sulfur levels specified in the IMO regulations. The distillate-based fuels, however, typically have a high cost premium and limited flexibility in blending components. For instance, use of heavy and highly aromatic components in a distillate-based low-sulfur marine fuel is limited because of the density, MCR content, appearance (color), and cetane specifications imposed on marine distillate fuels. A distinct advantage that resid-based marine fuel oils have over distillate-based marine fuels is that they can incorporate heavy and aromatic components into their formulations because of their product specifications. This allows more flexible use of available blending components for marine fuel oil production and results in lower cost fuels. Further, the use of heavy and highly aromatic components possible in resid-based marine fuel blends allows higher density fuels to be produced.

While there are some publications that disclose the desirability of lowering the sulfur content of marine fuels, there is still a need for low-sulfur marine fuels with at least one residual hydrocarbon component. Exemplary publications include U.S. Pat. Nos. 4,006,076, and 7,651,605, and WO2012135247.

SUMMARY

According to one aspect, the present disclosure provides a marine fuel composition comprising: 50 to 90 wt % of a residual hydrocarbon component; and 10 to 50 wt % selected from a group consisting of a non-hydroprocessed hydrocarbon component, a hydroprocessed hydrocarbon component, and any combination thereof. In some embodiments, the sulphur content is in a range of 400 to 1000 wppm. Additionally or alternately, the marine fuel composition exhibits at least one of the following characteristics: a hydrogen sulfide content of at most 2.0 mg/kg; an acid number of at most 2.5 mg KOH per gram; a sediment content of at most 0.1 wt %; a water content of at most 0.5 vol %; and an ash content of at most 0.15 wt %. Additionally or alternately, the marine fuel composition has at least one of the following: a density at 15 degrees C. in a range of 0.870 to 1.010 g/cm$^3$, a kinematic viscosity at 50 degrees C. in a range of 1 to 700 cSt, a pour point of −30 to 35 degrees C., and a flash point of at least 60 degrees C. In some embodiments, the residual hydrocarbon component has a sulfur content of at least 0.4 wt %, at least 0.2 wt %, at most 0.4 wt % or at most 0.2 wt %.

In some embodiments, the residual hydrocarbon component is selected from a group consisting of long residues (ATB), short residues (VTB), and a combination thereof. In some embodiments, the residual hydrocarbon component comprises long residues (ATB) which exhibit at least one of the following: a pour point in a range of −19.0 to 64 degrees C., a flash point in a range of 80 to 213 degrees C.; an acid number of up to 8.00 mgKOH/g; a density at ~15 degrees C. of at most about 1.1 g/cc; and a kinematic viscosity at ~50 degrees C. in a range of 1.75 to 15000 cSt. In some embodiments, the residual hydrocarbon component comprises a first long residue (ATB) which exhibits at least one of the following a pour point of about 45 degrees C., a flash point of about 124 degrees C.; a density at ~15 degrees C. of about 0.91 g/cm$^3$, and a kinematic viscosity at ~50 degrees C. of about 165 cSt.

In some embodiments, the marine fuel composition comprises at least 60% of the first long residue. In some embodiments, the residual hydrocarbon component comprises a second long residue (ATB) which exhibits at least one of the following a pour point of about −2 degrees C., a flash point of about 207 degrees C.; a density at ~15 degrees C. of about 0.94 g/cm$^3$, and a kinematic viscosity at ~50 degrees C. of about 880 cSt. In some embodiments, the marine fuel composition comprises at least 20 wt % of the first long residue and at least 30% of the second long residue. In some embodiments, the marine fuel composition comprises at least 32 wt % of the second long residue. In some embodiments, the marine fuel composition comprises at least 32% of the first long residue. In some embodiments, the marine fuel composition comprises at least 60 wt % of the residual hydrocarbon component. In some embodiments, the marine fuel composition comprises at least 70 wt % of the residual hydrocarbon component. In some embodiments, the marine fuel composition comprises at least 80 wt % of the residual hydrocarbon component. In some embodiments, the marine fuel composition comprises at least 90 wt % of the residual hydrocarbon component.

In some embodiments, the residual hydrocarbon component comprises short residues (VTB) which exhibit at least one of the following: a density at 15 degrees C. in a range of 0.8 to 1.1 g/cc; a pour point in a range of −15.0 to 95 degrees C., a flash point in a range of 220 to 335 degrees C.; an acid number of up to 8.00 mgKOH/g; and a kinematic viscosity at 50 degrees C. in a range of 3.75 to 15000 cSt. In some embodiments, the non-hydroprocessed hydrocarbon component is selected from a group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), thermally cracked residue, thermally cracked heavy distillate, coker heavy distillates, and any combination thereof. In some embodiments, the marine fuel composition wherein the non-hydroprocessed hydrocarbon component is selected from a group consisting of vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof. In some embodiments, the non-hydroprocessed hydrocarbon component is selected from a group consisting of coker kerosene, thermally cracked kerosene, gas-to-liquids (GTL) wax, GTL hydrocarbons, straight-run diesel, straight-run kerosene, straight run gas oil (SRGO), and any combination thereof. In some embodiments, the hydroprocessed hydrocarbon component is selected from a group consisting of low-sulfur diesel (LSD) having a sulphur content of less than 500 wppm, ultra low-sulfur diesel (ULSD) having a sulphur content of less than 15 wppm; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate, hydrotreated diesel oil, and any combination thereof.

In some embodiments, the hydroprocessed hydrocarbon component is selected from a group consisting of hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms, hydrotreated thermally cracked VGO, and hydrotreated hydrocracker DAO, and any combination thereof. In some embodiments, the hydroprocessed hydrocarbon component is selected from a group consisting of ultra low sulfur kerosene (ULSK), hydrotreated jet fuel, hydrotreated kerosene, hydrotreated coker kerosene, hydrocracker diesel, hydrocracker kerosene, hydrotreated thermally cracked kerosene, and any combination thereof.

Advantages and other features of embodiments of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

The present disclosure generally relates to marine fuels, specifically marine fuels with low sulfur content comprising at least one residual hydrocarbon component. In one embodiment, a marine fuel composition having a density at 15 degrees C. of greater than 830 kg/m$^3$ as measured by a suitable standard method known to one of ordinary skill in the art, such as ASTM D4052. The marine fuel composition may meet the marine residual fuels standard of ISO 8217 (2010). The marine fuel composition may comprise at least about 50 and up to 90 wt % of a residual hydrocarbon component and at least about 10 and up to 50 wt % of other components selected from the group consisting of a non-hydroprocessed hydrocarbon component, a hydroprocessed hydrocarbon component, and a combination thereof. According to one aspect, the amount and material of the residual hydrocarbon component may be selected first, and the amount and material of the non-hydroprocessed hydrocarbon component and/or hydroprocessed hydrocarbon component can be determined based on their properties in view of the residual hydrocarbon component selection to form a marine fuel composition that meets the desired application, such as to meet a particular specification or regulation requirement.

In one embodiment, the marine fuel composition includes a residual hydrocarbon component in a range of about 50 to 90 wt % while still maintaining the sulfur content to meet regulations. In some embodiments, the marine fuel composition comprises about 50 to 90 wt %, of the residual hydrocarbon component. For example, the marine fuel composition may comprise at least 50 wt %, at least 55 wt %, at least 60 wt %, at least 65 wt %, at least 70 wt %, at least 75 wt %, at least 80 wt %, at least 85 wt %, and 90 wt %. The marine fuel composition may comprise at most about 90 wt %, for example, at most 85 wt %, at most 80 wt %, at most 75 wt %, at most 70 wt %, at most 65 wt %, at most 60 wt %, at most 55 wt %, or 50 wt %. In one embodiment, the marine fuel composition comprises greater than 50 wt % of the residual hydrocarbon component. The residual hydrocarbon component can include any suitable residual hydrocarbon component, including long residues, short residues, or a combination thereof. For instance, residual hydrocarbon components can be residues of distillation processes and may have been obtained as residues in the distillation of crude mineral oil under atmospheric pressure, producing straight run distillate fractions and a first residual oil, which is called "long residue" (or atmospheric tower bottoms (ATB)). The long residue is usually distilled at sub-atmospheric pressure to yield one or more so called "vacuum distillates" and a second residual oil, which is called "short residue" (or vacuum tower bottoms (VTB)).

In a particular embodiment, the residual hydrocarbon component used has a sulfur content of less than about 0.4 wt %, for example, less than about 0.2 wt %. The residual hydrocarbon component with a sulfur content of less than about 0.4 wt % may be selected from long residues (ATB), short residues (VTB), and a combination thereof. The long residues (ATB) may exhibit one or more of the following properties: a density at ~15 degrees C. of at most about 1.0 g/cc (or g/cm$^3$), for example, at most 0.95 g/cc, at most 0.90 g/cc, at most 0.85 g/cc, at most 0.80 g/cc, at most 0.75 g/cc, or at most 0.70 g/cc; a density at ~15 degrees C. of at least about 0.70 g/cc, for example, at least 0.75 g/cc, at least 0.80 g/cc, at least 0.85 g/cc, at least 0.90 g/cc, at least 0.95 g/cc, or at least 1.0 g/cc; a sulfur content of about at most 0.40 wt %, at most 0.35 wt %, at most 0.30 wt %, at most 0.25 wt %, at most 0.20 wt %, at most 0.15 wt %, at most 0.10 wt %, at most 0.05 wt %, or at most 0.01 wt %; a sulfur content of about at least 0.01 wt %, at least 0.05 wt %, at least 0.10 wt %, at least 0.15 wt %, at least 0.20 wt %, at least 0.25 wt %, at least 0.30 wt %, at least 0.35 wt %, or at least 0.40 wt %; a pour point of at least about −20.0 degrees C., such as −19.0 degrees C., for example, at least −15.0 degrees C., at least −10.0 degrees C., at least −5.0 degrees C., at least 0.0 degrees C., at least 5.0 degrees C., at least 10.0 degrees C., at least 15.0 degrees C., at least 20.0 degrees C., at least 25.0 degrees C., at least 30.0 degrees C., at least 35.0 degrees C., at least 40.0 degrees C., at least 45.0 degrees C., at least 50.0 degrees C., at least 55.0 degrees C., or at least 60.0 degrees C., such as 64.0 degrees C.; a pour point of at most about 65.0 degrees C., such as 64.0 degrees C., for example, at most 60.0 degrees C., at most 55.0 degrees C., at most 50.0 degrees C., at most 45.0 degrees C., at most 40.0 degrees C., at most 35.0 degrees C., at most 30.0 degrees C., at most 25.0 degrees C., at most 20.0 degrees C., at most 15.0 degrees C., at most 10.0 degrees C., at most 5.0 degrees C., at most 0.0 degrees C., at most −5.0 degrees C., at most −10.0 degrees C., at most −15.0 degrees C., such as −19.0 degrees C., or at most −20.0 degrees C.; a flash point of at least about 80 degrees C., for example, at least 85 degrees C., at least 90 degrees C., at least 95 degrees C., at least 100 degrees C., at least 105 degrees C., at least 110 degrees C., at least 115 degrees C., at least 120 degrees C., at least 125 degrees C., at least 130 degrees C., at least 135 degrees C., at least 140 degrees C., at least 145 degrees C., at least 150 degrees C., at least 155 degrees C., at least 160 degrees C., at least 165 degrees C., at least 170 degrees C., at least 175 degrees C., at least 180 degrees C., at least 185 degrees C., at least 190 degrees C., at least 195 degrees C., at least 200 degrees C., at least 205 degrees C., or at least 210 degrees C., such as 213 degrees C.; a flash point of at most about 213 degrees C., for example, at most 210 degrees C., at most 205 degrees C., at most 200 degrees C., at most 195 degrees C., at most 190 degrees C., at most 185 degrees C., at most 180 degrees C., at most 175 degrees C., at most 170 degrees C., at most 165 degrees C., at most 160 degrees C., at most 155 degrees C., at most 150 degrees C., at most 145 degrees C., at most 140 degrees C., at most 135 degrees C., at most 130 degrees C., at most 125 degrees C., at most 120 degrees C., at most 115 degrees C., at most 110 degrees C., at most 105 degrees C., at most 100 degrees C., at most 95 degrees C., at most 90 degrees C., at most 85 degrees C., or at most 80 degrees C.; a total acid number (TAN) of up to about 8.00 mgKOH/g, for example, at most about 7.50 mgKOH/g, at most 7.00 mgKOH/g, at most 6.50 mgKOH/g, at most 6.00 mgKOH/g, at most 5.50 mgKOH/g, at most 5.00 mgKOH/g, at most 4.50 mgKOH/g, at most 4.00 mgKOH/g, at most 3.50 mgKOH/g, at most 3.00 mgKOH/g, at most 2.50 mgKOH/g, at most 2.00 mgKOH/g, at most 1.50 mgKOH/g, at most 1.00 mgKOH/g, at most 0.50 mgKOH/g, at most 0.10 mgKOH/g, or at most 0.05 mgKOH/g; a total acid number (TAN) of at least about 0.05 mgKOH/g, for example, at least 0.10 mgKOH/g, at least 0.50 mgKOH/g, at least 1.00 mgKOH/g, at least 1.50 mgKOH/g, at least 2.00 mgKOH/g, at least 2.50 mgKOH/g, at least 3.00 mgKOH/g, at least 3.50 mgKOH/g, at least 4.00 mgKOH/g, at least 4.50 mgKOH/g, at least 5.00 mgKOH/g, at least 5.50 mgKOH/g, at least 6.00 mgKOH/g, at least 6.50 mgKOH/g, at least 7.00 mgKOH/g, at least 7.50 mgKOH/g, or at least 8.00 mgKOH/g; a kinematic viscosity at ~50 degrees C. of at least about 1.75 cSt, for example, at least 100 cSt, at least 500 cSt, at least 1000 cSt, at least 1500 cSt, at least 2000 cSt, at least 2500 cSt, at least 3000 cSt, at least 3500 cSt, at least 4000 cSt, at least 4500 cSt, at least 5000 cSt, at least 5500 cSt, at least 6000 cSt, at least 6500 cSt, at least 7000 cSt, at least 7500 cSt, at least 8000 cSt, at least 8500 cSt, at least 9000 cSt, at least 9500 cSt, at least 10000 cSt, at least 10500 cSt, at least 11000 cSt, at least 11500 cSt, at least 12000 cSt, at least 12500 cSt, at least 13000 cSt, at least 13500 cSt, at least 14000 cSt, at least 14500 cSt, or at least 15000 cSt; a kinematic viscosity at ~50 degrees C. of at most about 15000 cSt, for example, at most 14500 cSt, at most 14000 cSt, at most 13500 cSt, at most 13000 cSt, at most 12500 cSt, at most 12000 cSt, at most 11500 cSt, at most 11000 cSt, at most 10500 cSt, at most 10000 cSt, at most 9500 cSt, at most 9000 cSt, at most 8500 cSt, at most 8000 cSt, at most 7500 cSt, at most 7000 cSt, at most 6500 cSt, at most 6000 cSt, at most 5500 cSt, at most 5000 cSt, at most 4500 cSt, at most 4000 cSt, at most 3500 cSt, at most 3000 cSt, at most 2500 cSt, at most 2000 cSt, at most 1500 cSt, at most 1000 cSt, at most 500 cSt, at most 100 cSt, or at most 1.75 cSt.

The short residues (VTB) may exhibit one or more of the following properties: a density at ~15 degrees C. of at most about 1.1 g/cc, for example, at most 1.05 g/cc, at most 1.00 g/cc, at most 0.95 g/cc, at most 0.90 g/cc, at most 0.85 g/cc, or at most 0.80 g/cc; a density at ~15 degrees C. of at least about 0.80 g/cc, for example, at least 0.85 g/cc, at least 0.90 g/cc, at least 0.95 g/cc, at least 1.0 g/cc, at least 1.05 g/cc, or at least 1.10 g/cc; a sulfur content of about at most 0.40 wt %, at most 0.35 wt %, at most 0.30 wt %, at most 0.25 wt %, at most 0.20 wt %, at most 0.15 wt %, at most 0.10 wt %, at most 0.05 wt %, or at most 0.01 wt %; a sulfur content of about at least 0.01 wt %, at least 0.05 wt %, at least 0.10 wt %, at least 0.15 wt %, at least 0.20 wt %, at least 0.25 wt %, at least 0.30 wt %, at least 0.35 wt %, or at least 0.40 wt %; a pour point in a range of at least −15.0 degrees C., for example, at least −15.0 degrees C., at least −10 degrees C., at least −5 degrees C., at least 0.0 degrees C., at least 5.0 degrees C., at least 10.0 degrees C., at least 15.0 degrees C., at least 20.0 degrees C., at least 25.0 degrees C., at least 30.0 degrees C., at least 35.0 degrees C., at least 40.0 degrees C., at least 45.0 degrees C., at least 50.0 degrees C., at least 55.0 degrees C., at least 60.0 degrees C. at least 65.0 degrees C., at least 70.0 degrees C., at least 75.0 degrees C., at least 80.0 degrees C., at least 85.0 degrees C., at least 90.0 degrees C., or at least 95.0 degrees C.; a pour point of at most about 95.0 degrees C., for example, at most 90.0 degrees C., at most 85.0 degrees C., at most 80.0 degrees C., at most 75.0 degrees C., at most 70.0 degrees C., at most 65.0 degrees C., at most 60.0 degrees C., at most 55.0 degrees C., at most 50.0 degrees C., at most 45.0 degrees C., at most 40.0 degrees C., at most 35.0 degrees C., at most 30.0 degrees C., at most 25.0 degrees C., at most 20.0 degrees C., at most 15.0 degrees C., at most 10.0 degrees C., at most 5.0 degrees C., at most 0.0 degrees C., at most −5.0 degrees C., at most −10 degrees C., at most −15.0 degrees C.; a flash point of at least about 220 degrees C., for example, at least 225 degrees C., at least 230 degrees C., at least 235 degrees C., at least 240 degrees C., at least 245 degrees C., at least 250 degrees C., at least 255 degrees C., at least 260 degrees C., at least 265 degrees C., at least 270 degrees C., at least 275 degrees C., at least 280 degrees C., at least 285 degrees C., at least 290 degrees C., at least 295 degrees C., at least 300 degrees C., at least 305 degrees C., at least 310 degrees C., at least 315 degrees C., at least 320 degrees C., at least 325 degrees C., at least 330 degrees C., or at least 335 degrees C.; a flash point of at most about 335 degrees C., for example, at most 330 degrees C., at most 325 degrees C., at most 320 degrees C., at most 315 degrees C., at most 310 degrees C., at most 305 degrees C., at most 300 degrees C., at most 295 degrees C., at most 290 degrees C., at most 285 degrees C., at most 280 degrees C., at most 275 degrees C., at most 270 degrees C., at most 265 degrees C., at most 260 degrees C., at most 255 degrees C., at most 250 degrees C., at most 245 degrees C., at most 240 degrees C., at most 235 degrees C., at most 230 degrees C., at most 225 degrees C., or at most 220 degrees C.; a total acid number (TAN) of up to about 8.00 mgKOH/g, for example, at most about 7.50 mgKOH/g, at most 7.00 mgKOH/g, at most about 6.50 mgKOH/g, at most 6.00 mgKOH/g, at most 5.50 mgKOH/g, at most 5.00 mgKOH/g, at most 4.50 mgKOH/g, at most 4.00 mgKOH/g, at most 3.50 mgKOH/g, at most 3.00 mgKOH/g, at most 2.50 mgKOH/g, at most 2.00 mgKOH/g, at most 1.50 mgKOH/g, at most 1.00 mgKOH/g, at most 0.50 mgKOH/g, at most 0.10 mgKOH/g, or at most 0.05 mgKOH/g; a total acid number (TAN) of at least about 0.05 mgKOH/g, for example, at least 0.10 mgKOH/g, at least 0.50 mgKOH/g, at least 1.00 mgKOH/g, at least 1.50 mgKOH/g, at least 2.00 mgKOH/g, at least 2.50 mgKOH/g, at least 3.00 mgKOH/g, at least 3.50 mgKOH/g, at least 4.00 mgKOH/g, at least 4.50 mgKOH/g, at least 5.00 mgKOH/g, at least 5.50 mgKOH/g, at least 6.00 mgKOH/g, at least 6.50 mgKOH/g, at least 7.00 mgKOH/g, at least 7.50 mgKOH/g, or at least 8.00 mgKOH/g; a kinematic viscosity at ~50 degrees C. of at least about 3.75 cSt, for example, at least 100 cSt, at least 500 cSt, at least 1000 cSt, at least 1500 cSt, at least 2000 cSt, at least 2500 cSt, at least 3000 cSt, at least 3500 cSt, at least 4000 cSt, at least 4500 cSt, at least 5000 cSt, at least 5500 cSt, at least 6000 cSt, at least 6500 cSt, at least 7000 cSt, at least 7500 cSt, at least 8000 cSt, at least 8500 cSt, at least 9000 cSt, at least 9500 cSt, at least 10000 cSt, at least 10500 cSt, at least 11000 cSt, at least 11500 cSt, at least 12000 cSt, at least 12500 cSt, at least 13000 cSt, at least 13500 cSt, at least 14000 cSt, at least 14500 cSt, or at most 15000 cSt; a kinematic viscosity at ~50 degrees C. of at most about 15000 cSt, for example, at most 14500 cSt, at most 14000 cSt, at most 13500 cSt, at most 13000 cSt, at most 12500 cSt, at most 12000 cSt, at most 11500 cSt, at most 11000 cSt, at most 10500 cSt, at most 10000 cSt, at most 9500 cSt, at most 9000 cSt, at most 8500 cSt, at most 8000 cSt, at most 7500 cSt, at most 7000 cSt, at most 6500 cSt, at most 6000 cSt, at most 5500 cSt, at most 5000 cSt, at most 4500 cSt, at most 4000 cSt, at most 3500 cSt, at most 3000 cSt, at most 2500 cSt, at most 2000 cSt, at most 1500 cSt, at most 1000 cSt, at most 500 cSt, or at most 3.75 cSt. The characteristics can be determined using any suitable standardized test method, such as ASTM D445 for viscosity, ASTM D4294 for sulfur content, ASTM D9 for flash point, and ASTM D97 for pour point.

In a particular embodiment, the residual hydrocarbon component may be selected from a group consisting of long residues (ATB), short residues (VTB), and a combination thereof, where the long residues may exhibit one or more of the following characteristics: a density at ~15 degrees C. in a range of about 0.7 to 1.0 g/cc; a sulfur content in a range of about 0.01 to 0.40 wt %; a pour point in a range of about −19.0 to 64.0 degrees C.; a flash point in a range of about 80 to 213 degrees C.; a total acid number (TAN) of up to about 8.00 mgKOH/g; and a kinematic viscosity at ~50 degrees C. in a range of about 1.75 to 15000 cSt; and where the short residues (VTB) may exhibit one or more of the following properties: a density at ~15 degrees C. in a range of about 0.8 to 1.1 g/cc; a sulfur content in a range of about 0.01 to 0.40 wt %; a pour point in a range of about −15.0 to 95 degrees C.; a flash point in a range of about 220 to 335 degrees C.; a total acid number (TAN) of up to about 8.00 mgKOH/g; and a kinematic viscosity at ~50 degrees C. in a range of about 3.75 to 15000 cSt. It is understood that there can be different kinds of long and short residues that exhibit various properties as described above that may be similar or different to each other. One or more kinds of long and/or short residues exhibiting one or more characteristics provided above may be used to provide the residual hydrocarbon component in the desired amount, e.g., in a range of 50 to 90 wt % of the overall marine fuel composition.

In some embodiments, the residual hydrocarbon component comprises two types of long residues (ATB). For example, one type of long residues may exhibit one or more of the following characteristics: a density at ~15 degrees C. of about 0.910 g/cc; a sulfur content of about 1000 wppm; a pour point of about 45 degrees C.; a flash point of about 124 degrees C.; and a kinematic viscosity at ~50 degrees C. of about 165 cSt. The second type of long residues may exhibit one or more of the following characteristics: a density at ~15 degrees C. of about 0.941 g/cc; a sulfur content of about 1130 wppm; a pour point of about −2 degrees C.; a flash point of about 207 degrees C.; and a kinematic viscosity at ~50 degrees C. of about 880 cSt.

The remaining about 10 to 50 wt % of the marine fuel composition can comprise one or more hydrocarbon components other than the residual hydrocarbon component, where the one or more hydrocarbon components is selected from a non-hydroprocessed hydrocarbon component, a hydroprocessed hydrocarbon component, and a combination thereof. For example, the marine fuel composition may comprise the non-hydroprocessed hydrocarbon component in an amount of at least 5 wt %, at least 10 wt %, at least 15 wt %, at least 20 wt %, at least 25 wt %, at least 30 wt %, at least 40 wt %, at least 45 wt %, or 50 wt %. The marine fuel composition may comprise the non-hydroprocessed hydrocarbon component in an amount of at most 50 wt %, at most 45 wt %, at most 40 wt %, at most 35 wt %, at most 30 wt %, at most 25 wt %, at most 20 wt %, at most 25 wt %, at most 20 wt %, at most 15 wt %, at most 10 wt %, at most 5 wt %, or none. In one embodiment, the marine fuel composition comprises greater than about 10 wt % of the non-hydroprocessed hydrocarbon component, such as about 11 wt %, 12 wt %, 13 wt %, 14 wt %, or 15 wt %; or greater than 15 wt %, such as about 16 wt %, 17 wt %, 18 wt %, 19 wt %, or 20 wt %; or greater than 20 wt %, such as about 21 wt %, 22 wt %, 23 wt %, 24 wt %, or 25 wt %. In some embodiments, the non-hydroprocessed hydrocarbon includes hydrocarbon products derived from oil cuts or cuts of a petrochemical origin which have not been subjected to hydrotreatment or hydroproces sing (HT). Non-limiting examples of hydrotreatment or hydroprocessing includes hydrocracking, hydrodeoxygenation, hydrodesulphurization, hydrodenitrogenation and/or hydroisomerization.

In a particular embodiment, the non-hydroprocessed hydrocarbon component is selected from the group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), thermally cracked residue (also called tar or thermal tar), thermally cracked heavy distillate, coker heavy distillates, which is heavier than diesel, and any combination thereof. In other embodiments, in addition to or alternatively, the non-hydroprocessed hydrocarbon component is selected from the group consisting of vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof. In yet another embodiment, in addition to or alternatively, the non-hydroprocessed hydrocarbon component is selected from the group consisting of coker kerosene, thermally cracked kerosene, gas-to-liquids (GTL) wax, GTL hydrocarbons, straight-run diesel, straight-run kerosene, straight run gas oil (SRGO), and any combination thereof. While preferred, a non-hydroprocessed hydrocarbon component is not required in a marine fuel composition described herein, particularly when a residual hydrocarbon component and a hydroprocessed hydrocarbon component can provide the marine fuel composition with the requisite or desired properties. Also, one or more kinds of non-hydroprocessed hydrocarbon component may be used to provide the marine fuel composition with the desired characteristics.

The materials listed above have their ordinary meaning as understood by one of ordinary skill in the art. For example, LCO is herein preferably refers to a fraction of FCC products of which at least 80 wt %, more preferably at least 90 wt %, boils in the range from equal to or more than 221° C. to less than 370° C. (at a pressure of 0.1 MegaPascal). HCO is herein preferably refers to a fraction of the FCC products of which at least 80 wt %, more preferably at least 90 wt %, boils in the range from equal to or more than 370° C. to less 425° C. (at a pressure of 0.1 MegaPascal). Slurry oil is herein preferably refers to a fraction of the FCC products of which at least 80 wt %, more preferably at least 90 wt %, boils at or above 425° C. (at a pressure of 0.1 MegaPascal).

Additionally or alternatively, the marine fuel composition can comprise a hydroprocessed hydrocarbon component. For example, the marine fuel composition may comprise the hydroprocessed hydrocarbon component in an amount of at least 5 wt %, at least 10 wt %, at least 15 wt %, at least 20 wt %, at least 25 wt %, at least 30 wt %, at least 40 wt %, at least 45 wt %, or 50 wt %. The marine fuel composition may comprise the hydroprocessed hydrocarbon component in an amount of at most 50 wt %, at most 45 wt %, at most 40 wt %, at most 35 wt %, at most 30 wt %, at most 25 wt %, at most 20 wt %, at most 15 wt %, at most 10 wt %, at most 5 wt %, or none. The marine fuel composition can comprise greater than 20 wt % of the hydroprocessed hydrocarbon component. The hydroprocessed hydrocarbon component can be derived from oil cuts or cuts of a petrochemical origin which have been subjected to hydrotreatment or hydroprocessing, which can be referred to as hydrotreated. Non-limiting examples of hydrotreatment or hydroprocessing includes hydrocracking, hydrodeoxygenation, hydrodesulphurization, hydrodenitrogenation and/or hydroisomerization.

In a particular embodiment, the hydroprocessed hydrocarbon component can comprise at least one of low-sulfur diesel (LSD) of less than about 500 wppm of sulfur, particularly ultra low-sulfur diesel (ULSD) of less than 15 or 10 wppm of sulfur; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate. In another embodiment, in addition to or alternatively, the hydroprocessed hydrocarbon component can comprise at least one of hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms (which can also be known as hydrocracker hydrowax), hydrotreated thermally cracked VGO, and hydrotreated hydrocracker DAO. In yet another embodiment, in addition to or alternatively, the hydroprocessed hydrocarbon component can comprise at least one of ultra low sulfur kerosene (ULSK), hydrotreated jet fuel, hydrotreated kerosene, hydrotreated coker kerosene, hydrocracker diesel, hydrocracker kerosene, hydrotreated thermally cracked kerosene. While preferred, a hydroprocessed hydrocarbon component is not required in a marine fuel composition described herein, particularly when a residual hydrocarbon component and a non-hydroprocessed hydrocarbon component can provide the marine fuel composition with the requisite or desired properties. Also, one or more kinds of hydroprocessed hydrocarbon component may be used to provide the marine fuel composition with the desired characteristics.

Additionally or alternately, in certain embodiments, the marine fuel composition can comprise other components aside from components (i) the residual hydrocarbon, (ii) the hydroprocessed hydrocarbon, and (iii) the non-hydroprocessed hydrocarbon. Such other components may typically be present in fuel additives. Examples of such other components can include, but are not limited to, detergents, viscosity modifiers, pour point depressants, lubricity modifiers, dehazers, e.g. alkoxylated phenol formaldehyde polymers; anti-foaming agents (e.g., polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; combustion improvers; and mixtures thereof.

Examples of detergents suitable for use in fuel additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-147240, EP-A-482253, EP-A-613938, EP-A-557516 and WO-A-9842808.

In one embodiment, if present, a lubricity modifier enhancer may be conveniently used at a concentration of less than 1000 ppmw, preferably from 50 to 1000 or from 100 to 1000 ppmw, more preferably from 50 to 500 ppmw. Suitable commercially available lubricity enhancers include ester- and acid-based additives. It may also be preferred for the fuel composition to contain an anti-foaming agent, more preferably in combination with an anti-rust agent and/or a corrosion inhibitor and/or a lubricity modifying additive. Unless otherwise stated, the concentration of each such additional component in the fuel composition is preferably up to 10000 ppmw, more preferably in the range from 0.1 to 1000 ppmw, advantageously from 0.1 to 300 ppmw, such as from 0.1 to 150 ppmw (all additive concentrations quoted in this specification refer, unless otherwise stated, to active matter concentrations by weight). The concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The concentration of any ignition improver present will preferably be 2600 ppmw or less, more preferably 2000 ppmw or less, conveniently from 300 to 1500 ppmw.

If desired, one or more additive components, such as those listed above, may be co-mixed—preferably together with suitable diluent(s)—in an additive concentrate, and the additive concentrate may then be dispersed into the base fuel, or into the base fuel/wax blend, in order to prepare a fuel composition according to the present invention.

In one embodiment, the marine fuel composition has a maximum sulfur content of 1000 wppm (parts per million by weight) or 0.1%. In some embodiments, the marine fuel composition can exhibit a sulfur content in a range of about 850 wppm to 1000 wppm, for example about 900 wppm, 950 wppm, or 1000 wppm. In other embodiments, the marine fuel composition can exhibit a sulfur content of at most 1000 wppm, for example at most 1000 wppm, at most 950 wppm, at most 900 wppm, at most 850 wppm, at most 800 wppm, at most 750 wppm, at most 700 wppm, at most 650 wppm, at most 600 wppm, at most 550 wppm, at most 500 wppm, at most 450 wppm, at most 400 wppm, at most 350 wppm, at most 300 wppm, or at most 250 wppm. In some embodiments, the marine fuel composition can exhibit a sulfur content of at least 250 wppm, at least 300 wppm, at least 350 wppm, at least 400 wppm, at least 450 wppm, at least 500 wppm, at least 550 wppm, at least 600 wppm, at least 650 wppm, at least 700 wppm, at least 750 wppm, at least 800 wppm, at least 850 wppm, or at least 900 wppm, at least 950 wppm, at least 1000.

It is understood that the sulfur content of the residual hydrocarbon component, the non-hydroprocessed hydrocarbon component, and/or the hydroprocessed hydrocarbon component, individually, can vary, as long as the marine fuel composition as a whole meets the sulfur target content requirement for a certain embodiment. Likewise, in one embodiment, it is understood that other characteristics of the residual hydrocarbon component, the non-hydroprocessed hydrocarbon component, and/or the hydroprocessed hydrocarbon component, individually, can vary, as long as the marine fuel composition meets the requirements of a standardization, such as ISO 8217. As such, certain embodiments can allow for greater use of cracked materials, for example, 25 wt % or greater.

Still further additionally or alternately, in some embodiments, the marine fuel composition can exhibit one or more of the following characteristics: a kinematic viscosity at about 50° C. (according to a suitable standardized test method, e.g., ASTM D445) of at most about 700 cSt, for example at most 500 cSt, at most 380 cSt, at most 180 cSt, at most 80 cSt, at most 55 cSt, at most 50 cSt, at most 45 cSt, at most 40 cSt, at most 35 cSt, at most 30 cSt, at most 25 cSt, at most 20 cSt, at most 15 cSt, at most 10 cSt, or at most 5 cSt; for example, about 4, 5, 6, 7, 8, 9, 10, 11, 12, 13, 14, 15, 16, 17, 18, 19, 20, or 21 cSt; a kinematic viscosity at about 50° C. (according to a suitable standardized test method, e.g., ASTM D445) of at least 5 cSt, for example at least 10 cSt, at least 15 cSt, at least 20 cSt, at least 25 cSt, at least 30 cSt, at least 35 cSt, at least 40 cSt, at least 45 cSt; at least 50 cSt, at least 55 cSt, at least 80 cSt, at least 180 cSt, at least 380 cSt, at least 500 cSt, or at least 700 cSt; a density at about 15° C. (according to a suitable standardized test method, e.g., ASTM D4052) of at most 1.010 g/cm$^3$, for example, at most 1.005, at most 1.000, at most 0.995, such as 0.991 g/cm$^3$, at most 0.990 g/cm$^3$, at most 0.985 g/cm$^3$, at most 0.980 g/cm$^3$, at most 0.975 g/cm$^3$, at most 0.970 g/cm$^3$, at most 0.965 g/cm$^3$, at most 0.960 g/cm$^3$, at most 0.955 g/cm$^3$, at most 0.950 g/cm$^3$, at most 0.945 g/cm$^3$, at most 0.940 g/cm$^3$, at most 0.935 g/cm$^3$, at most 0.930 g/cm$^3$, at most 0.925 g/cm$^3$, at most 0.920 g/cm$^3$, at most 0.915 g/cm$^3$, at most 0.910 g/cm$^3$, at most 0.905 g/cm$^3$, at most 0.900 g/cm$^3$, at most 0.895 g/cm$^3$, at most 0.890 g/cm$^3$, at most 0.885 g/cm$^3$, or at most 0.880 g/cm$^3$; a density at about 15° C. (according to a suitable standardized test method, e.g., ASTM D4052) of at least 0.870 g/cm$^3$, at least 0.875 g/cm$^3$, at least 0.880 g/cm, at least 0.885 g/cm$^3$, at least 0.890 g/cm$^3$, at least 0.895 g/cm$^3$, at least 0.900 g/cm$^3$, at least 0.905 g/cm$^3$, at least 0.910 g/cm$^3$, at least 0.915 g/cm$^3$, at least 0.920 g/cm$^3$, at least 0.925 g/cm$^3$, at least 0.930 g/cm$^3$, at least 0.935 g/cm$^3$, at least 0.940 g/cm$^3$, at least 0.945 g/cm$^3$, at least 0.950 g/cm$^3$, at least 0.955 g/cm$^3$, at least 0.960 g/cm$^3$, at least 0.965 g/cm$^3$, at least 0.970 g/cm$^3$, at least 0.975 g/cm$^3$, at least 0.980 g/cm$^3$, at least 0.985 g/cm$^3$, at least 0.990 g/cm$^3$, such as 0.991 g/cm$^3$, at least 0.995 g/cm$^3$, at least 1.000 g/cm$^3$, at least 1.005 g/cm$^3$, or at least 1.010 g/cm$^3$; a pour point (according to a suitable standardized test method, e.g., ASTM D97) of at most 35° C., at most 30° C., for example, at most 28° C., at most 25° C., at most 20° C., at most 15° C., at most 10° C., for example 6° C., at most 5° C., at most 0° C., at most −5° C., at most −10° C., at most −15° C., at most −20° C., at most −25° C., such as −27° C., or at most −30° C.; a pour point (according to a suitable standardized test method, e.g., ASTM D97) of at least −30° C., such as −27° C., for example, at least −25° C., at least −20° C., at least −15° C., at least −10° C., at least −5° C., at least 0° C., at least 5° C., at least 7° C., at least 10° C., at least 15° C., at least 20° C., at least 25° C., at least 30° C., or at least 35° C., and a flash point (according to a suitable standardized testing method, e.g., ASTM D93 Proc. 9 (Automatic)) of at least about 60° C., for example, at least 65° C., at least 70° C., at least 75° C., at least 80° C., at least 85° C., at least 90° C., at least 95° C., at least 100° C., at least 105° C., at least 110° C., at least 115° C., at least 120° C., at least 125° C., or at least 130° C.; an acid number (also known as Total Acid Number or TAN) of at most 2.5 mgKOH/g, for example, at most 2.0 mgKOH/g, at most 1.5 mgKOH/g, at most 1.0 mgKOH/g, or at most 0.5 mgKOH/g; an acid number of at least 0.5 mgKOH/g, at least 1.0 mgKOH/g, at least 1.5 mgKOH/g, at least 2.0 mgKOH/g, or at least 2.5 mgKOH/g.

In one embodiment, the marine fuel composition may exhibit one or more of the following characteristics: a kinematic viscosity at about 50° C. (according to a suitable standardized test method, e.g., ASTM D445) in a range of about 0 to 700 cSt, for example, at most 700.0 cSt, at most 500.0 cSt, at most 380.0 cSt, at most 180.0 cSt, at most 80.00 cSt, at most 30.00 cSt, or at most 10.00 cSt; a density at about 15° C. (according to a suitable standardized test method, e.g., ASTM D4052) in a range of about 0.870 to 1.010 g/cm$^3$, for example, at most 0.920 g/cm$^3$, at most 0.960 g/cm$^3$, at most 0.975 g/cm$^3$, at most 0.991 g/cm$^3$, or at most 1.010 g/cm$^3$, particularly, at least 0.890 g/cm$^3$; a pour point (according to a suitable standardized test method, e.g., ASTM D97) in a range of about −30 to 35° C., such as −27 to 30° C., for example, at most 6 to 30 degrees C. or at most 0 to 30 degrees C.; a flash point (according to a suitable standardized testing method, e.g., ASTM D93 Proc. 9 (Automatic)) in a range of about 60 to 130° C., for example, at least 60 degrees C.; an acid number in a range of about 0.0 to 2.5 mgKOH/g, for example, at most about 2.5 mgKOH/g.

Yet still further additionally or alternately, the low sulfur marine and/or bunker fuels, e.g., made according to the methods disclosed herein, can exhibit at least one of the following characteristics: a hydrogen sulfide content (according to a suitable standardized test method, e.g., IP 570) of at most about 2.0 mg/kg; an acid number (according to a suitable standardized test method, e.g., ASTM D-664) of at most about 2.5 mg KOH per gram; a sediment content (according to according to a suitable standardized test method, e.g., ASTM D4870 Proc. B) of at most about 0.1 wt %; a water content (according to according to according to a suitable standardized test method, e.g., ASTM D95) of at most about 0.5 vol %, for example about 0.3 vol %; and an ash content (according to a suitable standardized testing method, e.g., ASTM D482) of at most about 0.15 wt %, for example, about 0.10 wt %, 0.07 wt %, or 0.04 wt %.

According to a yet further aspect, there is provided a process for the preparation of a marine fuel composition comprising at least about 50 and up to 90 wt % of a residual hydrocarbon component and at least about 10 and up to 50 wt % of other components selected from a non-hydroprocessed hydrocarbon component, a hydroprocessed hydrocarbon component, and a combination thereof, wherein the marine fuel composition has a sulfur content of about 0.1 wt % (1000 wppm) or less. The process involves selecting a relative composition amount and material of the residual hydrocarbon component; selecting a relative composition amount and material of the non-hydroprocessed hydrocarbon component and/or hydroprocessed hydrocarbon component based on the residual hydrocarbon component selection to provide the composition sulfur content of about 0.1 wt % or less; and blending the selected components to form the marine fuel composition. In one embodiment, the selected residual hydrocarbon component has a sulfur content of 0.4 wt % or less. In another embodiment, the residual hydrocarbon component, non-hydroprocessed hydrocarbon component and/or hydroprocessed hydrocarbon component are selected to provide the marine fuel composition with characteristics that meet a standard specification, such as, but not limited to ISO 8217.

To facilitate a better understanding of the present invention, the following examples of preferred or representative embodiments are given. In no way should the following examples be read to limit, or to define, the scope of the invention.

EXAMPLES

The following are non-limiting Examples 1-107 of exemplary embodiments of the marine fuel composition described herein. The residual hydrocarbon component can comprise at least one of two types of long residues: ATB(1) and ATB(2). The non-hydroprocessed hydrocarbon component, if present, can be selected from a group consisting of slurry oil, pyrolysis gas oil ("Pygas oil"), LCO, thermally cracked residue (which can also be known as thermal tar), and Group I slack waxes. The hydroprocessed hydrocarbon component, if present, can be selected from a group consisting of hydroprocessed LCO that contains up to 400 wppm of sulfur ("400 LCO"), hydroprocessed LCO that contains up to 15 wppm of sulfur ("15 LCO"), ULSD, and hydrocracker bottoms (which can also be known as hydrowax). Examples 1-101 are prophetic examples, and the characteristics of these materials in Examples 1-101 are provided in Table 1 below.

TABLE 1

Characteristics of respective components in Examples 1-101

| | Density @ ~15° C. (kg/m$^3$) | Sulfur (wppm) | Pour Point (° C.) | Flash Point (° C.) | Viscosity @ ~50° C. (CSt) |
|---|---|---|---|---|---|
| ATB (1) | ~0.910 | ~1000 | ~45 | ~124 | ~165 |
| ATB (2) | ~0.941 | ~1130 | ~−2 | ~207 | ~880 |
| Slurry Oil | ~1.093 | ~4000 | ~0 | ~100 | ~800 |
| Pygas Oil | ~0.960 | ~1000 | ~0 | ~80 | ~10 |
| LCO | ~0.989 | ~1590 | ~−15 | ~80 | ~10 |
| Thermal Tar | ~1.026 | ~5000 | ~6 | ~66 | ~1213 |
| Slack Wax | ~0.814 | ~32 | ~35 | ~60 | ~10 |
| 400 LCO | ~0.880 | ~400 | ~−15 | ~88 | ~2 |
| 15 LCO | ~0.959 | ~15 | ~−18 | ~61 | ~2 |
| ULSD | ~0.860 | ~15 | ~0 | ~60 | ~2 |
| Hydrowax | ~0.838 | ~100 | ~39 | ~210 | ~18 |

Examples 1-11

In prophetic Examples 1-11, each of the marine fuel composition can include about 55 wt % of a residual hydrocarbon component. In Examples 1-6, the residual hydrocarbon component can comprise 20 wt % of long residues ATB(1) and 35 wt % of long residues ATB(2). In Examples 7-11, the residual hydrocarbon component can comprise 35 wt % of long residues ATB(1) and 20 wt % of long residues ATB(2). The remaining about 45 wt % of the respective marine fuel composition can be selected from a non-hydroprocessed hydrocarbon component, a hydroprocessed hydrocarbon component, and a combination thereof. Table 2 below summarizes the blend content of the marine fuel composition in Examples 1-11.

TABLE 2

Blend content of Examples 1-11

| Blend | Residual component | | Non-hydroprocessed component | | | | | Hydroprocessed component | | | |
|---|---|---|---|---|---|---|---|---|---|---|---|
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 1 | 20 | 35 | 0 | 0 | 18 | 0 | 0 | 27 | 0 | 0 | 0 |
| Ex. 2 | 20 | 35 | 5 | 0 | 10 | 0 | 0 | 0 | 0 | 30 | 0 |
| Ex. 3 | 20 | 35 | 0 | 0 | 25 | 0 | 20 | 0 | 0 | 0 | 0 |
| Ex. 4 | 20 | 35 | 0 | 0 | 20 | 0 | 0 | 0 | 10 | 0 | 15 |
| Ex. 5 | 20 | 35 | 0 | 25 | 0 | 0 | 0 | 0 | 20 | 0 | 0 |
| Ex. 6 | 20 | 35 | 0 | 0 | 20 | 1 | 0 | 0 | 24 | 0 | 0 |
| Ex. 7 | 35 | 20 | 0 | 0 | 20 | 0 | 0 | 25 | 0 | 0 | 0 |
| Ex. 8 | 35 | 20 | 5 | 0 | 10 | 0 | 0 | 0 | 0 | 30 | 0 |
| Ex. 9 | 35 | 20 | 0 | 0 | 25 | 0 | 20 | 0 | 0 | 0 | 0 |
| Ex. 10 | 35 | 20 | 0 | 0 | 20 | 0 | 0 | 0 | 10 | 0 | 15 |
| Ex. 11 | 35 | 20 | 0 | 25 | 0 | 0 | 0 | 0 | 20 | 0 | 0 |

Table 3 below provides certain characteristics that the marine fuel composition of Examples 1-11 would be expected to have, as measured by a respective standard testing method.

TABLE 3

Expected characteristics of the marine fuel composition in Examples 1-11

| | Density @ ~15° C. (g/cc) | Sulfur (wppm) | Pour Point (° C.) | Flash Point (° C.) | Viscosity @ ~50° C. (cSt) |
|---|---|---|---|---|---|
| Ex. 1 | 0.925 | 990 | 14.2 | 100.2 | 23.8 |
| Ex. 2 | 0.919 | 959 | 16.3 | 81.2 | 26.1 |
| Ex. 3 | 0.917 | 999 | 22.5 | 108.0 | 54.0 |

TABLE 3-continued

| Expected characteristics of the marine fuel composition in Examples 1-11 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 4 | 0.928 | 930 | 21.7 | 95.8 | 44.1 |
| Ex. 5 | 0.943 | 849 | 15.5 | 85.2 | 29.0 |
| Ex. 6 | 0.949 | 967 | 14.1 | 83.4 | 26.9 |
| Ex. 7 | 0.923 | 994 | 23.1 | 98.7 | 21.9 |
| Ex. 8 | 0.915 | 940 | 24.6 | 80.8 | 22.7 |
| Ex. 9 | 0.913 | 980 | 29.2 | 106.4 | 45.6 |
| Ex. 10 | 0.924 | 911 | 28.6 | 94.9 | 37.5 |
| Ex. 11 | 0.938 | 829 | 24.0 | 84.7 | 25.1 |

Examples 12-30

In prophetic Examples 12-30, each of the marine fuel composition can include about 60 wt % of a residual hydrocarbon component. In Examples 12 to 18, the residual hydrocarbon component can comprise 20 wt % of long residues ATB(1) and 40 wt % of long residues ATB(2). In Examples 19 to 30, the residual hydrocarbon component can comprise 30 wt % of long residues ATB(1) and 30 wt % of long residues ATB(2). The remaining about 40 wt % of the respective marine fuel composition can be selected from a non-hydroprocessed hydrocarbon component, a hydroprocessed hydrocarbon component, and a combination thereof. Table 4 below summarizes the blend content of the marine fuel composition in Examples 12-30.

TABLE 4

| Blend content of Examples 12-30 | | | | | | | | | | | |
|---|---|---|---|---|---|---|---|---|---|---|---|
| Blend | Residual component | | Non-hydroprocessed component | | | | | Hydroprocessed component | | | |
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 12 | 20 | 40 | 0 | 0 | 20 | 0 | 0 | 0 | 0 | 0 | 20 |
| Ex. 13 | 20 | 40 | 0 | 0 | 20 | 0 | 20 | 0 | 0 | 0 | 0 |
| Ex. 14 | 20 | 40 | 0 | 0 | 20 | 0 | 0 | 0 | 0 | 20 | 0 |
| Ex. 15 | 20 | 40 | 0 | 0 | 15 | 0 | 0 | 25 | 0 | 0 | 0 |
| Ex. 16 | 20 | 40 | 0 | 0 | 21 | 0 | 0 | 0 | 19 | 0 | 0 |
| Ex. 17 | 20 | 40 | 0 | 25 | 0 | 0 | 0 | 0 | 15 | 0 | 0 |
| Ex. 18 | 20 | 40 | 0 | 0 | 17 | 1 | 0 | 0 | 22 | 0 | 0 |
| Ex. 19 | 30 | 30 | 0 | 0 | 22 | 0 | 0 | 0 | 18 | 0 | 0 |
| Ex. 20 | 30 | 30 | 5 | 0 | 0 | 0 | 0 | 35 | 0 | 0 | 0 |
| Ex. 21 | 30 | 30 | 0 | 0 | 17 | 1 | 0 | 0 | 22 | 0 | 0 |
| Ex. 22 | 30 | 30 | 0 | 0 | 15 | 0 | 0 | 25 | 0 | 0 | 0 |
| Ex. 23 | 30 | 30 | 0 | 30 | 0 | 0 | 0 | 10 | 0 | 0 | 0 |
| Ex. 24 | 30 | 30 | 8 | 0 | 0 | 0 | 0 | 0 | 0 | 32 | 0 |
| Ex. 25 | 30 | 30 | 0 | 0 | 20 | 0 | 20 | 0 | 0 | 0 | 0 |
| Ex. 26 | 30 | 30 | 0 | 0 | 20 | 0 | 0 | 0 | 0 | 0 | 20 |
| Ex. 27 | 30 | 30 | 0 | 20 | 0 | 0 | 0 | 20 | 0 | 0 | 0 |
| Ex. 28 | 30 | 30 | 0 | 0 | 0 | 0 | 0 | 40 | 0 | 0 | 0 |
| Ex. 29 | 30 | 30 | 0 | 30 | 0 | 0 | 0 | 0 | 10 | 0 | 0 |
| Ex. 30 | 30 | 30 | 0 | 20 | 10 | 0 | 0 | 0 | 10 | 0 | 0 |

Table 5 below provides certain characteristics that the marine fuel composition of Examples 12-30 would be expected to have, as measured by a respective standard testing method.

TABLE 5

| Expected characteristics of the marine fuel composition in Examples 12-30 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 12 | 0.921 | 990 | 24.0 | 112.4 | 80.5 |
| Ex. 13 | 0.915 | 976 | 22.7 | 112.5 | 67.1 |
| Ex. 14 | 0.926 | 973 | 15.6 | 85.9 | 35.0 |
| Ex. 15 | 0.925 | 991 | 14.4 | 102.8 | 30.2 |
| Ex. 16 | 0.947 | 989 | 14.3 | 87.1 | 36.1 |
| Ex. 17 | 0.942 | 904 | 15.8 | 89.0 | 40.8 |
| Ex. 18 | 0.947 | 976 | 14.4 | 85.5 | 34.3 |
| Ex. 19 | 0.944 | 992 | 20.5 | 87.1 | 33.5 |
| Ex. 20 | 0.916 | 979 | 20.9 | 106.1 | 24.6 |
| Ex. 21 | 0.944 | 963 | 21.7 | 85.2 | 32.8 |
| Ex. 22 | 0.922 | 978 | 20.7 | 101.9 | 27.3 |
| Ex. 23 | 0.930 | 979 | 22.0 | 99.2 | 42.9 |
| Ex. 24 | 0.914 | 964 | 22.5 | 81.7 | 29.8 |
| Ex. 25 | 0.912 | 963 | 27.3 | 111.1 | 59.6 |
| Ex. 26 | 0.918 | 977 | 28.4 | 111.1 | 71.1 |
| Ex. 27 | 0.922 | 919 | 21.6 | 101.0 | 31.6 |
| Ex. 28 | 0.906 | 799 | 20.7 | 105.0 | 18.3 |
| Ex. 29 | 0.939 | 941 | 22.0 | 91.2 | 42.9 |
| Ex. 30 | 0.941 | 1000 | 21.5 | 91.2 | 42.9 |

Examples 31-61

In prophetic Examples 31-61, each of the marine fuel composition can include about 70 wt % of a residual hydrocarbon component. In Examples 31-42, the residual hydrocarbon component can comprise 30 wt % of long residues ATB(1) and 40 wt % of long residues ATB(2). In Examples 43-55, the residual hydrocarbon component can comprise 40 wt % of long residues ATB(1) and 30 wt % of long residues ATB(2). In Examples 56-61, the residual hydrocarbon component can comprise 50 wt % of long residues ATB(1) and 20 wt % of long residues ATB(2). The remaining about 30 wt % of the respective marine fuel composition can be selected from a non-hydroprocessed hydrocarbon component, a hydroprocessed hydrocarbon component, and a combination thereof. Table 6 below summarizes the blend content of the marine fuel composition in Examples 31-61.

TABLE 6

Blend content of Examples 31-61

| Blend | Residual component | | Non-hydroprocessed component | | | | | Hydroprocessed component | | | |
|---|---|---|---|---|---|---|---|---|---|---|---|
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 31 | 30 | 40 | 0 | 0 | 15 | 0 | 0 | 0 | 0 | 15 | 0 |
| Ex. 32 | 30 | 40 | 5 | 0 | 0 | 0 | 0 | 10 | 0 | 15 | 0 |
| Ex. 33 | 30 | 40 | 0 | 0 | 15 | 0 | 15 | 0 | 0 | 0 | 0 |
| Ex. 34 | 30 | 40 | 0 | 20 | 0 | 0 | 0 | 10 | 0 | 0 | 0 |
| Ex. 35 | 30 | 40 | 0 | 24 | 0 | 0 | 0 | 0 | 6 | 0 | 0 |
| Ex. 36 | 30 | 40 | 0 | 24 | 0 | 0 | 0 | 0 | 0 | 6 | 0 |
| Ex. 37 | 30 | 40 | 0 | 0 | 11 | | 1 | 0 | 0 | 18 | 0 |
| Ex. 38 | 30 | 40 | 0 | 0 | 15 | 0 | 0 | 0 | 5 | 0 | 10 |
| Ex. 39 | 30 | 40 | 0 | 0 | 10 | 0 | 0 | 0 | 0 | 0 | 20 |
| Ex. 40 | 30 | 40 | 0 | 0 | 10 | 0 | 0 | 20 | 0 | 0 | 0 |
| Ex. 41 | 30 | 40 | 0 | 0 | 15 | 0 | 0 | 0 | 15 | 0 | 0 |
| Ex. 42 | 30 | 40 | 0 | 0 | 15 | 0 | 0 | 0 | 0 | 15 | 0 |
| Ex. 43 | 40 | 30 | 0 | 10 | 10 | 0 | 0 | 0 | 10 | 0 | 0 |
| Ex. 44 | 40 | 30 | 0 | 0 | 15 | 0 | 0 | 0 | 5 | 0 | 10 |
| Ex. 45 | 40 | 30 | 0 | 0 | 16 | 0 | 14 | 0 | 0 | 0 | 0 |
| Ex. 46 | 40 | 30 | 0 | 0 | 16 | 0 | 0 | 0 | 0 | 14 | 0 |
| Ex. 47 | 40 | 30 | 0 | 0 | 11 | 0 | 0 | 19 | 0 | 0 | 0 |
| Ex. 48 | 40 | 30 | 0 | 20 | 0 | 0 | 0 | 10 | 0 | 0 | 0 |
| Ex. 49 | 40 | 30 | 0 | 0 | 10 | 0 | 0 | 10 | 0 | 0 | 10 |
| Ex. 50 | 40 | 30 | 5 | 0 | 0 | 0 | 0 | 0 | 25 | 0 | 0 |
| Ex. 51 | 40 | 30 | 0 | 0 | 0 | 0 | 0 | 20 | 0 | 10 | 0 |
| Ex. 52 | 40 | 30 | 0 | 0 | 0 | 0 | 0 | 19 | 0 | 0 | 11 |
| Ex. 53 | 40 | 30 | 0 | 0 | 13 | 0 | 12 | 5 | 0 | 0 | 0 |
| Ex. 54 | 40 | 30 | 0 | 0 | 13 | 0 | 0 | 7 | 0 | 0 | 10 |
| Ex. 55 | 40 | 30 | 0 | 0 | 15 | 0 | 0 | 0 | 0 | 15 | 0 |
| Ex. 56 | 50 | 20 | 0 | 0 | 12 | 0 | 0 | 18 | 0 | 0 | 0 |
| Ex. 57 | 50 | 20 | 0 | 0 | 15 | 0 | 0 | 0 | 15 | 0 | 0 |
| Ex. 58 | 50 | 20 | 0 | 0 | 0 | 0 | 0 | 30 | 0 | 0 | 0 |
| Ex. 59 | 50 | 20 | 0 | 0 | 0 | 0 | 0 | 0 | 30 | 0 | 0 |
| Ex. 60 | 50 | 20 | 0 | 5 | 0 | 0 | 0 | 0 | 25 | 0 | 0 |
| Ex. 61 | 50 | 20 | 5 | 0 | 0 | 0 | 0 | 0 | 25 | 0 | 0 |

Table 7 below provides certain characteristics that the marine fuel composition of Examples 31-61 would be expected to have, as measured by a respective standard testing method.

TABLE 7

Expected characteristics of the marine fuel composition in Examples 31-61

| | Density @ ~15° C. (g/cc) | Sulfur (wppm) | Pour Point (° C.) | Flash Point (° C.) | Viscosity @ ~50° C. (cSt) |
|---|---|---|---|---|---|
| Ex. 31 | 0.925 | 993 | 21.7 | 91.3 | 55.1 |
| Ex. 32 | 0.918 | 994 | 22.0 | 93.7 | 48.7 |
| Ex. 33 | 0.917 | 995 | 26.1 | 116.4 | 94.1 |
| Ex. 34 | 0.929 | 992 | 22.0 | 105.4 | 65.4 |
| Ex. 35 | 0.937 | 993 | 22.1 | 98.1 | 75.4 |

TABLE 7-continued

| Expected characteristics of the marine fuel composition in Examples 31-61 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 36 | 0.930 | 993 | 22.4 | 97.7 | 75.4 |
| Ex. 37 | 0.940 | 980 | 21.0 | 90.0 | 52.1 |
| Ex. 38 | 0.928 | 1001 | 25.1 | 104.9 | 85.8 |
| Ex. 39 | 0.913 | 931 | 28.7 | 123.2 | 114.4 |
| Ex. 40 | 0.923 | 991 | 21.0 | 107.8 | 46.7 |
| Ex. 41 | 0.941 | 993 | 20.9 | 92.0 | 55.1 |
| Ex. 42 | 0.925 | 993 | 21.7 | 91.3 | 55.1 |
| Ex. 43 | 0.936 | 1000 | 26.3 | 94.6 | 58.1 |
| Ex. 44 | 0.924 | 988 | 29.4 | 104.0 | 75.7 |
| Ex. 45 | 0.915 | 998 | 30.0 | 113.7 | 82.8 |
| Ex. 46 | 0.923 | 996 | 26.5 | 91.4 | 50.8 |
| Ex. 47 | 0.921 | 990 | 26.0 | 106.5 | 43.2 |
| Ex. 48 | 0.925 | 979 | 26.7 | 104.5 | 58.1 |
| Ex. 49 | 0.915 | 948 | 29.4 | 112.8 | 63.4 |
| Ex. 50 | 0.939 | 943 | 26.0 | 87.4 | 43.6 |
| Ex. 51 | 0.907 | 821 | 26.3 | 96.8 | 30.9 |
| Ex. 52 | 0.904 | 826 | 29.7 | 117.0 | 47.3 |
| Ex. 53 | 0.914 | 970 | 29.4 | 113.3 | 69.1 |
| Ex. 54 | 0.918 | 984 | 29.4 | 111.9 | 70.4 |
| Ex. 55 | 0.922 | 980 | 26.5 | 90.8 | 49.2 |
| Ex. 56 | 0.919 | 989 | 30.1 | 105.3 | 40.0 |
| Ex. 57 | 0.934 | 967 | 30.0 | 91.0 | 44.0 |
| Ex. 58 | 0.907 | 846 | 30.1 | 108.2 | 28.0 |
| Ex. 59 | 0.930 | 731 | 30.0 | 84.1 | 28.0 |
| Ex. 60 | 0.930 | 780 | 30.1 | 86.1 | 32.4 |
| Ex. 61 | 0.936 | 930 | 30.1 | 87.0 | 39.1 |

Examples 62-71

In prophetic Examples 62-71, each of the marine fuel composition can include about 75 wt % of a residual hydrocarbon component, which can comprise 45 wt % of long residues ATB(1) and 30 wt % of long residues ATB(2). The remaining about 25 wt % of the respective marine fuel composition can be selected from a non-hydroprocessed hydrocarbon component, a hydroprocessed hydrocarbon component, and a combination thereof. Table 8 below summarizes the blend content of the marine fuel composition in Examples 62-71.

TABLE 8

| Blend content of Examples 62-71 | | | | | | | | | | | |
|---|---|---|---|---|---|---|---|---|---|---|---|
| Blend | Residual component | | Non-hydroprocessed component | | | | | Hydroprocessed component | | | |
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 62 | 45 | 30 | 0 | 0 | 13 | 0 | 0 | 0 | 12 | 0 | 0 |
| Ex. 63 | 45 | 30 | 0 | 20 | 0 | 0 | 0 | 0 | 5 | 0 | 0 |
| Ex. 64 | 45 | 30 | 0 | 20 | 0 | 0 | 0 | 0 | 0 | 5 | 0 |
| Ex. 65 | 45 | 30 | 0 | 0 | 0 | 0 | 0 | 25 | 0 | 0 | 0 |
| Ex. 66 | 45 | 30 | 0 | 0 | 13 | 0 | 0 | 0 | 0 | 12 | 0 |
| Ex. 67 | 45 | 30 | 0 | 0 | 0 | 0 | 0 | 20 | 0 | 0 | 5 |
| Ex. 68 | 45 | 30 | 0 | 17 | 0 | 0 | 0 | 8 | 0 | 0 | 0 |
| Ex. 69 | 45 | 30 | 0 | 0 | 0 | 0 | 5 | 20 | 0 | 0 | 0 |
| Ex. 70 | 45 | 30 | 0 | 0 | 9 | 0 | 0 | 16 | 0 | 0 | 0 |
| Ex. 71 | 45 | 30 | 0 | 0 | 10 | 0 | 5 | 10 | 0 | 0 | 0 |

Table 9 below provides certain characteristics that the marine fuel composition of Examples 62-71 would be expected to have, as measured by a respective standard testing method.

TABLE 9

| Characteristics of the marine fuel composition in Examples 62-71 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 62 | 0.935 | 998 | 28.2 | 95.1 | 63.6 |
| Ex. 63 | 0.931 | 990 | 28.9 | 100.5 | 81.7 |
| Ex. 64 | 0.926 | 990 | 29.1 | 100.1 | 81.7 |
| Ex. 65 | 0.911 | 889 | 28.3 | 111.8 | 41.4 |
| Ex. 66 | 0.922 | 998 | 28.7 | 94.5 | 63.6 |
| Ex. 67 | 0.909 | 874 | 29.9 | 115.4 | 50.6 |
| Ex. 68 | 0.925 | 991 | 28.9 | 107.2 | 73.2 |
| Ex. 69 | 0.907 | 871 | 29.6 | 115.4 | 48.6 |
| Ex. 70 | 0.921 | 996 | 28.3 | 109.2 | 55.5 |
| Ex. 71 | 0.918 | 990 | 29.6 | 112.1 | 68.2 |

Examples 72-91

In prophetic Examples 72-91, each of the marine fuel composition can include about 80 wt % of a residual hydrocarbon component. In Examples 72 to 83, the residual hydrocarbon component can comprise 30 wt % of long residues ATB(1) and 50 wt % of long residues ATB(2). In Examples 84 to 91, the residual hydrocarbon component can comprise 40 wt % of long residues ATB(1) and 40 wt % of long residues ATB(2). The remaining about 20 wt % of the respective marine fuel composition can be selected from a non-hydroprocessed hydrocarbon component, a hydroprocessed hydrocarbon component, and a combination thereof. Table 10 below summarizes the blend content of the marine fuel composition in Examples 72-91.

TABLE 10

| Blend content of Examples 72-91 | | | | | | | | | | | |
|---|---|---|---|---|---|---|---|---|---|---|---|
| Blend | Residual component | | Non-hydroprocessed component | | | | | Hydroprocessed component | | | |
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 72 | 30 | 50 | 0 | 0 | 0 | 0 | 0 | 0 | 20 | 0 | 0 |
| Ex. 73 | 30 | 50 | 0 | 0 | 0 | 0 | 0 | 0 | 0 | 20 | 0 |
| Ex. 74 | 30 | 50 | 0 | 0 | 0 | 0 | 0 | 20 | 0 | 0 | 0 |
| Ex. 75 | 30 | 50 | 0 | 0 | 8 | 0 | 0 | 0 | 12 | 0 | 0 |
| Ex. 76 | 30 | 50 | 0 | 0 | 8 | 0 | 0 | 0 | 0 | 12 | 0 |
| Ex. 77 | 30 | 50 | 0 | 9 | 0 | 0 | 0 | 11 | 0 | 0 | 0 |
| Ex. 78 | 30 | 50 | 0 | 13 | 0 | 0 | 0 | 0 | 7 | 0 | 0 |
| Ex. 79 | 30 | 50 | 0 | 13 | 0 | 0 | 0 | 0 | 0 | 7 | 0 |
| Ex. 80 | 30 | 50 | 0 | 13 | 0 | 0 | 7 | 0 | 0 | 0 | 0 |
| Ex. 81 | 30 | 50 | 0 | 12 | 0 | 0 | 0 | 0 | 0 | 0 | 8 |
| Ex. 82 | 30 | 50 | 0 | 0 | 7 | 0 | 0 | 0 | 0 | 0 | 13 |
| Ex. 83 | 30 | 50 | 0 | 0 | 8 | 0 | 12 | 0 | 0 | 0 | 0 |
| Ex. 84 | 40 | 40 | 0 | 0 | 9 | 0 | 0 | 0 | 11 | 0 | 0 |
| Ex. 85 | 40 | 40 | 0 | 11 | 0 | 0 | 0 | 9 | 0 | 0 | 0 |
| Ex. 86 | 40 | 40 | 0 | 14 | 0 | 0 | 6 | 0 | 0 | 0 | 0 |
| Ex. 87 | 40 | 40 | 0 | 14 | 0 | 0 | 0 | 0 | 6 | 0 | 0 |
| Ex. 88 | 40 | 40 | 0 | 14 | 0 | 0 | 0 | 0 | 0 | 0 | 6 |
| Ex. 89 | 40 | 40 | 0 | 14 | 0 | 0 | 0 | 0 | 0 | 6 | 0 |
| Ex. 90 | 40 | 40 | 0 | 0 | 9 | 0 | 11 | 0 | 0 | 0 | 0 |
| Ex. 91 | 40 | 40 | 0 | 0 | 5 | 0 | 0 | 15 | 0 | 0 | 0 |

Table 11 below provides certain characteristics that the marine fuel composition of Examples 72-91 would be expected to have, as measured by a respective standard testing method.

TABLE 11

| Characteristics of the marine fuel composition in Examples 72-91 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 72 | 0.935 | 868 | 21.3 | 93.0 | 72.0 |
| Ex. 73 | 0.914 | 868 | 22.3 | 92.0 | 72.0 |
| Ex. 74 | 0.919 | 945 | 21.4 | 117.9 | 72.0 |
| Ex. 75 | 0.937 | 994 | 21.3 | 98.5 | 96.7 |
| Ex. 76 | 0.924 | 994 | 22.0 | 97.7 | 96.7 |
| Ex. 77 | 0.926 | 999 | 21.8 | 114.5 | 100.4 |
| Ex. 78 | 0.935 | 996 | 22.0 | 102.9 | 117.3 |
| Ex. 79 | 0.928 | 996 | 22.3 | 102.3 | 117.3 |
| Ex. 80 | 0.924 | 997 | 24.4 | 118.9 | 156.0 |
| Ex. 81 | 0.924 | 993 | 25.2 | 120.2 | 169.9 |
| Ex. 82 | 0.920 | 989 | 26.6 | 128.7 | 179.3 |
| Ex. 83 | 0.918 | 996 | 25.5 | 126.8 | 156.0 |
| Ex. 84 | 0.934 | 997 | 26.2 | 98.6 | 88.2 |
| Ex. 85 | 0.924 | 998 | 26.7 | 112.5 | 95.1 |
| Ex. 86 | 0.922 | 994 | 28.5 | 115.9 | 135.3 |
| Ex. 87 | 0.932 | 993 | 26.8 | 103.0 | 106.6 |
| Ex. 88 | 0.924 | 998 | 28.9 | 115.9 | 144.0 |
| Ex. 89 | 0.926 | 993 | 27.0 | 102.5 | 106.6 |

TABLE 11-continued

| Characteristics of the marine fuel composition in Examples 72-91 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 90 | 0.917 | 999 | 29.4 | 122.7 | 135.3 |
| Ex. 91 | 0.921 | 992 | 26.3 | 114.4 | 76.1 |

Examples 92-101

In prophetic Examples 92-101, each of the marine fuel composition can include about 90 wt % of a residual hydrocarbon component. In Examples 92 to 95, the residual hydrocarbon component can comprise 40 wt % of long residues ATB(1) and 50 wt % of long residues ATB(2). In Examples 96 to 99, the residual hydrocarbon component can comprise 45 wt % of long residues ATB(1) and 45 wt % of long residues ATB(2). In Examples 100 to 101, the residual hydrocarbon component can comprise 48 wt % of long residues ATB(1) and 42 wt % of long residues ATB(2). The remaining about 10 wt % of the respective marine fuel composition can be selected from a non-hydroprocessed hydrocarbon component, a hydroprocessed hydrocarbon component, and a combination thereof. Table 12 below summarizes the blend content of the marine fuel composition in Examples 92-101.

TABLE 12

| Blend content of Examples 92-101 | | | | | | | | | | | |
|---|---|---|---|---|---|---|---|---|---|---|---|
| Blend | Residual component | | Non-hydroprocessed component | | | | | Hydroprocessed component | | | |
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 92 | 40 | 50 | 0 | 0 | 0 | 0 | 0 | 0 | 10 | 0 | 0 |
| Ex. 93 | 40 | 50 | 0 | 0 | 0 | 0 | 10 | 0 | 0 | 0 | 0 |
| Ex. 94 | 40 | 50 | 0 | 0 | 0 | 0 | 0 | 0 | 0 | 0 | 10 |
| Ex. 95 | 40 | 50 | 0 | 0 | 0 | 0 | 0 | 0 | 0 | 10 | 0 |
| Ex. 96 | 45 | 45 | 0 | 0 | 0 | 0 | 0 | 10 | 0 | 0 | 0 |

TABLE 12-continued

| Blend content of Examples 92-101 | | | | | | | | | | | |
|---|---|---|---|---|---|---|---|---|---|---|---|
| Blend | Residual component | | Non-hydroprocessed component | | | | | Hydroprocessed component | | | |
| content (wt %) | ATB (1) | ATB (2) | Slurry Oil | Pygas Oil | LCO | Thermal tar | Slack Wax | 400 LCO | 15 LCO | ULSD | Hydro wax |
| Ex. 97 | 45 | 45 | 0 | 0 | 0 | 0 | 0 | 10 | 0 | 0 | 0 |
| Ex. 98 | 45 | 45 | 0 | 0 | 0 | 0 | 0 | 0 | 10 | 0 | 0 |
| Ex. 99 | 45 | 45 | 0 | 0 | 0 | 0 | 0 | 0 | 0 | 10 | 0 |
| Ex. 100 | 48 | 42 | 0 | 0 | 0 | 0 | 0 | 0 | 10 | 0 | 0 |
| Ex. 101 | 48 | 42 | 0 | 0 | 0 | 0 | 0 | 10 | 0 | 0 | 0 |

Table 13 below provides certain characteristics that the marine fuel composition of Examples 92-101 would be expected to have, as measured by a respective standard testing method.

TABLE 13

| Characteristics of the marine fuel composition in Examples 92-101 | | | | | |
|---|---|---|---|---|---|
| | Density @ ~15° C. (g/cc) | Sulfur (wppm) | Pour Point (° C.) | Flash Point (° C.) | Viscosity @ ~50° C. (cSt) |
| Ex. 92 | 0.930 | 967 | 26.5 | 105.6 | 151.3 |
| Ex. 93 | 0.914 | 968 | 29.4 | 145.1 | 233.3 |
| Ex. 94 | 0.917 | 975 | 30.0 | 144.9 | 261.7 |
| Ex. 95 | 0.920 | 967 | 27.0 | 104.7 | 151.3 |
| Ex. 96 | 0.920 | 999 | 28.7 | 125.1 | 140.9 |
| Ex. 97 | 0.920 | 999 | 28.7 | 125.1 | 140.9 |
| Ex. 98 | 0.928 | 960 | 28.6 | 105.2 | 140.9 |
| Ex. 99 | 0.918 | 960 | 29.0 | 104.3 | 140.9 |
| Ex. 100 | 0.927 | 956 | 29.8 | 104.9 | 135.1 |
| Ex. 101 | 0.919 | 995 | 29.9 | 124.4 | 135.1 |

Examples 102-106

The following are non-limiting Examples 102-106 of exemplary embodiments of the marine fuel composition described herein. The residual hydrocarbon component included at least one of two types of long residues: ATB(1) and ATB(2). The non-hydroprocessed hydrocarbon component, if used, was slurry oil. The hydroprocessed hydrocarbon component was ULSD. The characteristics of these materials are provided in Table 14 below.

TABLE 14

| Characteristics of blending components in Examples 102-106 | | | | |
|---|---|---|---|---|
| Characteristic | Long residues (ATB(1)) | Long residues (ATB(2)) | Slurry Oil | ULSD |
| Density @ ~15° C. (g/cc) | ~0.91 | ~0.94 | ~1.09 | ~0.83 |
| Kinematic Viscosity @ ~50° C. or ~122° F. (cSt) | ~180 | ~880 | ~800 | ~2 |

TABLE 14-continued

| Characteristics of blending components in Examples 102-106 | | | | |
|---|---|---|---|---|
| Characteristic | Long residues (ATB(1)) | Long residues (ATB(2)) | Slurry Oil | ULSD |
| Sulfur (wppm) | ~1250 | ~1130 | ~4000 | ~7 |
| Pour Point (° C.) | ~42 | ~−2 | ~0 | ~0 |
| Flash Point (° C.) | ~>110 | ~207 | ~100 | ~60 |

Table 15 below summarizes the blend content of the marine fuel composition in Examples 102-106.

TABLE 15

| Blend content of Examples 102-106 | | | | |
|---|---|---|---|---|
| Blend content | Residual Component | | Non-hydroprocessed | Hydroprocessed |
| (wt %) | ATB (1) | ATB (2) | Slurry Oil | ULSD |
| Ex. 102 | 20 | 32 | 5 | 43 |
| Ex. 103 | 32 | 32 | 2 | 34 |
| Ex. 104 | 30 | 40 | 0 | 30 |
| Ex. 105 | 30 | 50 | 0 | 20 |
| Ex. 106 | 30 | 55 | 0 | 15 |

Table 16 below provides certain characteristics of the marine fuel composition of Examples 102-106, as measured by the respective ASTM method. As can be seen below, the marine fuel composition of Examples 102-106 exhibited a sulfur content that is less than 0.1 wt %, which would allow these compositions to be used in geographical locations that are or will be under more stringent regulations government the sulfur content of marine fuels. In addition, the marine fuel composition of Examples 102-106 exhibited characteristics that allow them, if necessary or desired, to meet specifications that govern residual-based marine fuels, particularly ISO 8217.

TABLE 16

| Characteristics of the marine fuel composition of Examples 102-106 | | | | | | |
|---|---|---|---|---|---|---|
| Test Method | Characteristic | Ex. 102 | Ex. 103 | Ex. 104 | Ex. 105 | Ex. 106 |
| ASTM D4052 | API Gravity @ ~60° F. | 27.5 | 27.3 | 27.0 | 25.1 | 24.5 |
| | Density @ ~15° C. ($kg/m^3$) | 889.3 | 890.6 | 892.3 | 903.2 | 907.0 |
| ASTM D445 | Viscosity @ ~122° F. (cSt) | 21.16 | 13.77 | 27.03 | 52.88 | 62.65 |
| ASTM D4294 | Sulfur Content (mass %) | 0.094 | 0.092 | 0.082 | 0.089 | 0.100 |

TABLE 16-continued

| Characteristics of the marine fuel composition of Examples 102-106 | | | | | | |
|---|---|---|---|---|---|---|
| Test Method | Characteristic | Ex. 102 | Ex. 103 | Ex. 104 | Ex. 105 | Ex. 106 |
| ASTM D95 | Water by Distillation (% (v/v)) | <0.05 | <0.05 | <0.05 | <0.05 | <0.05 |
| ASTM D93 | Flash Point (° C.) | 64.5 | 69.5 | 71.5 | 80.5 | 85.0 |
| Proc. B (Automatic) | Flash Point (° F.) | 148 | 157 | 161 | 177 | 185 |
| ASTM D97 | Pour Point (° C.) | −21 | −6 | 12 | 6 | 12 |
| | Pour Point (° F.) | −6 | 21 | 54 | 43 | 54 |
| ASTM D4870 Proc. B | Accelerated Total Sediment (% (m/m)) | 0.02 | 0.01 | 0.02 | 0.01 | <0.01 |
| ASTM D482 | Ash Content (mass %) | 0.030 | 0.03 | 0.033 | 0.049 | 0.041 |
| IP 501 | Vanadium (ppm (mg/kg)) | <1 | 1 | 1 | 1 | 1 |
| | Sodium (ppm (mg/kg)) | 8 | 11 | 12 | 11 | 14 |
| | Aluminum (ppm (mg/kg)) | 6 | 6 | 1 | <1 | 1 |
| | Silicon (ppm (mg/kg)) | 12 | 15 | 13 | 27 | 10 |
| | Calcium (ppm (mg/kg)) | 73 | 69 | 85 | 116 | 114 |
| | Zinc (ppm (mg/kg)) | 1 | 1 | 2 | 3 | 2 |
| | Phosphorus (ppm (mg/kg)) | <1 | <1 | 1 | 2 | 1 |
| ASTM D4530 | Micro Carbon Residue (% (m/m)) | 2.58 | 2.70 | 2.75 | 3.57 | 3.78 |
| ASTM D664 | Total Acid Number (mg KOH/g) | 1.16 | 1.22 | 1.49 | 1.88 | 2.19 |
| IP 570 | $H_2S$ Content (ppm (mg/kg)) | 0.00 | 0.00 | 0.00 | <0.01 | <0.4 |
| ISO-FDIS 8217 | Calculated Carbon Aromaticity Index (CCAI) | 790.3 | 800.3 | 788.7 | 788.6 | 789.9 |

Example 107

Example 107 is a non-limiting exemplary embodiment of the marine fuel composition described herein. The relative fuel composition of the marine fuel composition was about 60 wt % of a residual hydrocarbon component, about 12 wt % of a non-hydroprocessed hydrocarbon component, and about 28 wt % of a hydroprocessed hydrocarbon component. In particular, the residual hydrocarbon component was long residues or ATB; the non-hydroprocessed hydrocarbon component included about 4 wt % of a first type of slurry oil (Slurry Oil (1), about 8 wt % of a second type of slurry oil (Slurry Oil (2)); and the hydroprocessed hydrocarbon component was hydrotreated diesel oil. The properties of these components are listed in Table 17 below.

TABLE 17

| Blend content and characteristics of blending components in Example 107 | | | | |
|---|---|---|---|---|
| Characteristic | Long residues (ATB) | Slurry Oil (1) | Slurry Oil (2) | Hydrotreated Diesel |
| Blend content (wt %) | ~60 | ~4 | ~8 | ~28 |
| Density @ ~15° C. (g/cc) | ~0.91 | ~0.95 | ~1.09 | ~0.8450 |
| Viscosity @ ~50° C. (cSt) | ~159 | ~42 | ~220 | ~3 |
| Sulfur (wppm) | ~1200 | ~2700 | ~2200 | ~50 |
| Pour Point (° C.) | ~45 | ~30 | ~3 | ~−8 |
| Flash Point (° C.) | ~110 | ~110 | ~155 | ~80 |

Table 18 below provides certain characteristics, as measured by the respective ISO method, of the marine fuel composition of Example 107. As can be seen below, the marine fuel composition of Example 107 had a sulfur content that is less than 0.1 wt %, which would allow it to be used in geographical locations that are or will be under more stringent regulations government the sulfur content of marine fuels. In addition, the marine fuel composition of Example 112 exhibited characteristics that allow it, if necessary or desired, to meet specifications that govern residual-based marine fuels, particularly ISO 8217.

TABLE 18

| Characteristics of the marine fuel composition of Example 107 | | | |
|---|---|---|---|
| Characteristic | Test Method | Unit | Value |
| Density at 15° C. | ISO 12185 | $kg/m^3$ | 903.7 |
| Kinematic Viscosity at 50° C. | ISO 3104 | $mm^2/s$ | 26.78 |
| Total Sulphur | ISO 8754 | % m/m | 0.097 |
| Flash Point | ISO 2719 B | ° C. | 81.0 |
| Water | ISO 3733 | % m/m | <0.1 |
| Pour Point | ISO 3016 (Automatic) | ° C. | 30 |
| Total Sediment Accelerated | ISO 10307-2 B | % m/m | <0.01 |
| Carbon Residue | ISO 10370 | % m/m | 3.03 |
| Ash Content | ISO 6245 | % m/m | <0.001 |
| Total Acid Number | ASTM D 664 | mg KOH/g | 0.08 |
| Aluminum | IP 501 | mg/kg | <5 |
| Silicon | IP 501 | mg/kg | <10 |
| Aluminum plus Silicon | IP 501 | mg/kg | <15 |
| Vanadium | IP 501 | mg/kg | 2 |
| Sodium | IP 501 | mg/kg | 15 |
| Calcium | IP 501 | mg/kg | 3 |
| Phosphorus | IP 501 | mg/kg | 1 |
| Zinc | IP 501 | mg/kg | 1 |
| CCAI | ISO 8217 | | 800 |
| Hydrogen Sulphide | IP 570 A | mg/kg | <0.60 |

Therefore, embodiments of the present invention are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, substituted, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount whether accompanied by the term "about" or not. In particular, the phrase "from about a to about b" is equivalent to the phrase "from approximately a to b," or a similar form thereof. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

We claim:

1. A marine fuel composition comprising:

55 to 90 wt % of a residual hydrocarbon component selected from an atmospheric tower bottoms (ATB) residue, a vacuum tower bottoms residues (VTB), or any combination thereof, wherein the residual hydrocarbon component has a kinematic viscosity at ~50 degrees C. of at least 100 cSt; and at least 10 and up to 45 wt % of the marine fuel composition selected from a non-hydroprocessed hydrocarbon component, a hydroprocessed hydrocarbon component, or any combination thereof, wherein the non-hydroprocessed hydrocarbon component comprises deasphalted oil (DAO);

wherein the marine fuel composition has a kinematic viscosity at ~50 degrees C. of at least 10 cSt.

2. The marine fuel composition of claim 1 wherein the residual hydrocarbon component has a sulphur content of at most 0.4 wt %.

3. The marine fuel composition of claim 1 wherein the sulphur content of the marine fuel composition is in a range of 400 to 1000 wppm.

4. The marine fuel composition of claim 1 which exhibits at least one of the following:

a hydrogen sulfide content of at most 2.0 mg/kg; an acid number of at most 2.5 mg KOH per gram; a sediment content of at most 0.1 wt %; a water content of at most 0.5 vol %; an ash content of at most 0.15 wt %; a density at 15 degrees C. in a range of 0.870 to 1.010 g/cm$^3$, a pour point of −30 to 35 degrees C., and a flash point of at least 60 degrees C.

5. The marine fuel composition of claim 1 wherein the atmospheric tower bottoms (ATB) residues exhibit at least one of the following: a density at 15 degrees C. in a range of 0.7 to 1.0 g/cc; a pour point in a range of −19.0 to 64 degrees C., a flash point in a range of 80 to 213 degrees C.; and an acid number of up to 8.00 mgKOH/g.

6. The marine fuel composition of claim 1 wherein the vacuum tower bottoms (VTB) residues exhibit at least one of the following: a density at 15 degrees C. in a range of 0.8 to 1.1 g/cc; a pour point in a range of −15.0 to 95 degrees C., a flash point in a range of 220 to 335 degrees C.; and an acid number of up to 8.00 mgKOH/g.

7. The marine fuel composition of claim 1 wherein, in addition to the DAO, the non-hydroprocessed hydrocarbon component further comprises at least one of a light cycle oil (LCO), a heavy cycle oil (HCO), a fluid catalytic cracking (FCC) cycle oil, a pyrolysis gas oil, a cracked light gas oil (CLGO), a cracked heavy gas oil (CHGO), a pyrolysis light gas oil (PLGO), a pyrolysis heavy gas oil (PHGO), a thermally cracked residue, a thermally cracked heavy distillate, a coker heavy distillates, a vacuum gas oil (VGO), a coker diesel, a coker gas oil, a coker VGO, a thermally cracked VGO, a thermally cracked diesel, a thermally cracked gas oil, a Group I slack wax, and a lube coil aromatic extract.

8. The marine fuel composition of claim 1 wherein the hydroprocessed hydrocarbon component selected from a group consisting of hydrotreated coker diesel, hydrotreated coker gas oil, hydrotreated thermally cracked diesel, hydrotreated VGO, hydrotreated coker VGO, hydrotreated residues, hydrocracker bottoms, hydrotreated thermally cracked VGO, and hydrotreated DAO, ultra-low sulphur kerosene (ULSK), hydrotreated jet fuel, hydrotreated kerosene, hydrotreated coker kerosene, hydrocracker kerosene, hydrotreated thermally cracked kerosene, and any combination thereof.

9. A marine fuel composition comprising:

55 to 90 wt % of a residual hydrocarbon component selected from an atmospheric tower bottoms (ATB) residue, a vacuum tower bottoms residues (VTB), or any combination thereof; and at least 10 and up to 45 wt % of the marine fuel composition selected from a non-hydroprocessed hydrocarbon component, a hydroprocessed hydrocarbon component, or any combination thereof.

10. The marine fuel composition of claim 9 wherein the non-hydroprocessed hydrocarbon component is selected from a group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), thermally cracked residue, thermally cracked heavy distillate, coker heavy distillates, vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), coker kerosene, thermally cracked kerosene, gas-to-liquids (GTL) wax, GTL hydrocarbons, straight-run diesel, straight-run kerosene, straight run gas oil (SRGO), and any combination thereof.

11. The marine fuel composition of claim 9 wherein the hydroprocessed hydrocarbon component is selected from a group consisting of low-sulfur diesel (LSD) having a sulphur content of less than 500 wppm, ultra low-sulfur diesel (ULSD) having a sulphur content of less than 15 wppm; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate, hydrotreated diesel oil, hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms, hydrotreated thermally cracked VGO, and hydrotreated hydrocracker DAO, and ultra low sulfur kerosene (ULSK), hydrotreated jet fuel, hydrotreated kerosene, hydrotreated coker kerosene, hydrocracker diesel, hydrocracker kerosene, hydrotreated thermally cracked kerosene, and any combination thereof.

12. The marine fuel composition of claim 9 wherein the atmospheric tower bottoms (ATB) residues exhibit the following: a pour point in a range of −19.0 to 64 degrees C., a flash point in a range of 80 to 213 degrees C.; an acid number of up to 8.00 mgKOH/g; a density at ~15 degrees C. of at most about 1.1 g/cc; and a kinematic viscosity at ~50 degrees C. in a range of 1.75 to 15000 cSt.

13. The marine fuel composition of claim 9 wherein the vacuum tower bottoms (VTB) residues exhibit the following: a density at 15 degrees C. in a range of 0.8 to 1.1 g/cc; a pour point in a range of −15.0 to 95 degrees C., a flash point in a range of 220 to 335 degrees C.; an acid number of up to 8.00 mgKOH/g; and a kinematic viscosity at 50 degrees C. in a range of 3.75 to 15000 cSt.

14. The marine fuel composition of claim 9 wherein the sulphur content of the marine fuel composition is in a range of 400 to 1000 wppm.

* * * * *